US012351954B2

(12) United States Patent
Ogata et al.

(10) Patent No.: US 12,351,954 B2
(45) Date of Patent: Jul. 8, 2025

(54) CLOTH AND FIBER ARTICLE

(71) Applicant: TEIJIN FRONTIER CO., LTD., Osaka (JP)

(72) Inventors: Nobuaki Ogata, Osaka (JP); Akio Ukuma, Osaka (JP); Sonomi Shibata, Osaka (JP)

(73) Assignee: TEIJIN FRONTIER CO., LTD., Osaka (JP)

( * ) Notice: Subject to any disclaimer, the term of this patent is extended or adjusted under 35 U.S.C. 154(b) by 506 days.

(21) Appl. No.: 17/287,160

(22) PCT Filed: Nov. 21, 2019

(86) PCT No.: PCT/JP2019/045588
§ 371 (c)(1),
(2) Date: Apr. 21, 2021

(87) PCT Pub. No.: WO2020/110890
PCT Pub. Date: Jun. 4, 2020

(65) Prior Publication Data

US 2021/0381141 A1 Dec. 9, 2021

(30) Foreign Application Priority Data

Nov. 27, 2018 (JP) ..... 2018-221391

(51) Int. Cl.

| | |
|---|---|
| ***D04B 1/20*** | (2006.01) |
| ***D01F 8/14*** | (2006.01) |
| ***D02G 3/32*** | (2006.01) |
| ***D03D 15/00*** | (2021.01) |
| ***D03D 15/283*** | (2021.01) |

(52) U.S. Cl.
CPC ..... *D04B 1/20* (2013.01); *D01F 8/14* (2013.01); *D02G 3/326* (2013.01); *D03D 15/00* (2013.01); *D03D 15/283* (2021.01); *D10B 2331/04* (2013.01); *D10B 2401/021* (2013.01); *D10B 2401/061* (2013.01); *D10B 2401/14* (2013.01); *D10B 2501/041* (2013.01); *D10B 2501/042* (2013.01); *D10B 2501/043* (2013.01); *D10B 2503/06* (2013.01)

(58) Field of Classification Search
None
See application file for complete search history.

(56) References Cited

U.S. PATENT DOCUMENTS

| | | | | | |
|---|---|---|---|---|---|
| 4,184,316 | A * | 1/1980 | Griset, Jr. | D02G 3/34 | 57/295 |
| 4,269,888 | A * | 5/1981 | Ejima | D01F 8/06 | 156/181 |
| 4,332,762 | A * | 6/1982 | Lynch | D01D 5/22 | 264/172.16 |
| 6,105,224 | A * | 8/2000 | O'Mara, Jr. | D02G 3/406 | 28/247 |
| 6,372,343 | B1 * | 4/2002 | Yamada | D04H 1/55 | 428/362 |
| 7,387,976 | B2 * | 6/2008 | Baba | B32B 5/26 | 156/304.6 |
| 7,645,508 | B2 * | 1/2010 | Uemura | D03D 15/292 | 428/370 |
| 8,276,405 | B2 * | 10/2012 | Ogata | D04B 21/16 | 66/171 |
| 9,702,064 | B2 * | 7/2017 | Goenka | D02G 3/04 | |
| 9,986,726 | B2 * | 6/2018 | Nakanishi | D02G 3/444 | |
| 10,161,065 | B2 * | 12/2018 | Ogata | D04B 1/24 | |
| 10,925,339 | B2 * | 2/2021 | Ogata | B60N 2/5891 | |
| 2001/0049016 | A1 * | 12/2001 | Yamanaka | D01F 9/22 | 264/168 |
| 2002/0071951 | A1 * | 6/2002 | Hernandez | D04H 1/42 | 428/397 |
| 2006/0182964 | A1 * | 8/2006 | Goda | D01F 8/14 | 428/364 |
| 2008/0085398 | A1 * | 4/2008 | Yasui | D03D 15/292 | 428/152 |
| 2018/0142384 | A1 | 5/2018 | Ogata | | |

FOREIGN PATENT DOCUMENTS

| | | | | | |
|---|---|---|---|---|---|
| CN | 107923089 | A | | 4/2018 | |
| JP | 52-8153 | A | | 1/1977 | |
| JP | 04082913 | A | * | 3/1992 | D01F 8/12 |
| JP | 7-3562 | A | | 1/1995 | |
| JP | 7-97731 | A | | 4/1995 | |
| JP | 2002-146641 | A | | 5/2002 | |
| JP | 2004270125 | A | * | 9/2004 | |
| JP | 2009-138287 | A | | 6/2009 | |
| JP | 2012-207328 | A | | 10/2012 | |
| JP | 2013-204202 | A | | 10/2013 | |

(Continued)

OTHER PUBLICATIONS

Supplementary European Search Report dated Dec. 22, 2021 in European Application No. 19888529.5.

(Continued)

*Primary Examiner* — Grace Huang

(74) *Attorney, Agent, or Firm* — Sughrue Mion, PLLC

(57) ABSTRACT

The invention addresses the problem of providing a cloth and a textile product, which are extremely excellent in stretchability and sweat-absorbing and quick-drying properties and further have a natural material-like texture and appearance. As a means for resolution, for example, a cloth is obtained using a composite yarn containing a crimped yarn and a stretch fiber.

5 Claims, No Drawings

(56) References Cited

FOREIGN PATENT DOCUMENTS

| | | | | |
|---|---|---|---|---|
| KR | 10-2018-0044910 | A | 5/2018 | |
| WO | 2008/001920 | A1 | 1/2008 | |
| WO | WO-2017038239 | A1 * | 3/2017 | ..... A41D 31/00 |
| WO | 2018/198846 | A1 | 11/2018 | |

OTHER PUBLICATIONS

International Preliminary Report on Patentability dated May 25, 2021 in International Application No. PCT/JP2019/045588.
Written Opinion of the International Searching Authority dated Feb. 10, 2020 in International Application No. PCT/JP2019/045588.
International Search Report for PCT/JP2019/045588 dated Feb. 10, 2020.
Office Action dated Mar. 23, 2022 issued by the Chinese Patent Office in Chinese Application No. 201980078125.7.
Office Action dated May 17, 2022 issued by the Japanese Patent Office in Japanese Application No. 2020-557616.

* cited by examiner

CLOTH AND FIBER ARTICLE

CROSS-REFERENCE TO RELATED APPLICATIONS

This application is a National Stage of International Application No. PCT/JP2019/045588 filed Nov. 21, 2019, which claims priority under U.S.C. § 119(a) to Japanese Patent Application No. 2018-221391 filed on Nov. 27, 2018.

TECHNICAL FIELD

The present invention relates to a cloth and a textile product, which are extremely excellent in stretchability and sweat-absorbing and quick-drying properties and further have a natural material-like texture and appearance.

BACKGROUND ART

Conventionally, in the field of sportswear, highly functional products for players are demanded, and stretchy cloths using crimped fibers have been proposed (e.g., PTL 1 and PTL 2). In addition, sweat-absorbing and quick-drying properties are also demanded.

However, it cannot be said yet that sufficient stretchability and sweat-absorbing and quick-drying properties have been achieved.

CITATION LIST

Patent Literature

PTL 1: WO 2008/001920
PTL 2: JP-A-2009-138287

SUMMARY OF INVENTION

Technical Problem

The invention has been accomplished against the above background. An object thereof is to provide a cloth and a textile product, which are extremely excellent in stretchability and sweat-absorbing and quick-drying properties and further have a natural material-like texture and appearance.

Solution to Problem

The present inventors have conducted extensive research to solve the above problems and, as a result, found that when a cloth is formed using a special composite yarn, a cloth that is extremely excellent in stretchability and sweat-absorbing and quick-drying properties and further has a natural material-like texture and appearance can be obtained. As a result of further extensive research, they have accomplished the invention.

Thus, the invention provides "a cloth including a composite yarn, the cloth being characterized in that the composite yarn contains a crimped yarn and a stretch fiber".

In this case, it is preferable that the crimped yarn contains a false-twist crimped yarn A having torque in the S-direction and a false-twist crimped yarn B having torque in the Z-direction. In addition, it is preferable that the stretch fiber is a conjugate fiber made of two components joined in a side-by-side manner or an eccentric sheath-core manner or is a polytrimethylene terephthalate fiber. In addition, it is preferable that the crimped yarn or the stretch fiber has a single fiber fineness within a range of 0.00002 to 2.0 dtex.

In addition, it is preferable that the composite yarn is an entangled yarn that has been subjected to interlacing processing to have 1 to 150 entanglements/m. In addition, it is preferable that the composite yarn has a total fineness within a range of 40 to 180 dtex.

In the cloth of the invention, it is preferable that the cloth is a woven fabric or a knitted fabric. In addition, it is preferable that the lateral stretchability measured in accordance with JIS L 1018-1990 is 10% or more. In addition, it is preferable that the rate of recovery of the lateral stretchability measured in accordance with JIS L 1018-1990 is 85% or more. In addition, it is preferable that the snagging resistance tested in accordance with JIS L 1058-1995, D3 Method, Hacksaw, for 15 hours is Class 3 or higher.

In addition, the invention provides a textile product using the above cloth and selected from the group consisting of garments, lining fabrics, interlining fabrics, socks, belly bands, hats, gloves, pajamas, futon's outer fabrics, futon covers, and car seat upholstery materials.

Advantageous Effects of Invention

According to the invention, a cloth and a textile product, which are extremely excellent in stretchability and sweat-absorbing and quick-drying properties and further have a natural material-like texture and appearance, are obtained.

DESCRIPTION OF EMBODIMENTS

Hereinafter, embodiments of the invention will be described in detail. A cloth of the invention includes a composite yarn containing a crimped yarn and a stretch fiber. In this case, it is preferable that the crimped yarn contains a false-twist crimped yarn A having torque in the S-direction and a false-twist crimped yarn B having torque in the Z-direction.

Here, false-twist crimped yarns include a so-called one-heater false-twist crimped yarn obtained by setting false twists in a first heater zone and a so-called second-heater false-twist crimped yarn obtained by further introducing such a yarn into a second heater zone and subjecting the same to a relaxation heat treatment to reduce the torque. In addition, depending on the direction of twisting, there exist a false-twist crimped yarn having torque in the S-direction and a false-twist crimped yarn having torque in the Z-direction. In the invention, these false-twist crimped yarns can be used.

The conditions for false-twist crimping are not limited, but the draw ratio in the false-twist crimping is preferably within a range of 0.8 to 1.5. The number of false twists is preferably such that a is within a range of 0.5 to 1.5 (more preferably 0.8 to 1.2) in the following equation: the number of false twists $(T/m)=(32{,}500/(D)^{1/2})\times\alpha$. D is the total fineness of the yarn (dtex). As a twisting apparatus used, a disk-type or belt-type friction twisting apparatus allows for easy threading, hardly causes yarn breakage, and thus is suitable. However, it is also possible to use a pin-type twisting apparatus.

As a fiber that forms the false-twist crimped yarn A or the false-twist crimped yarn B, polyester fibers, acrylic fibers, nylon fibers, rayon fibers, acetate fibers, natural fibers such as cotton, wool, and silk, and combinations thereof are usable. Polyester fibers include a conjugate fiber containing at least one polyester component. Examples of such conjugate fibers include side-by-side conjugate fibers, eccentric sheath-core conjugate fibers, core-sheath conjugate fibers, and islands-in-sea conjugate fibers. In addition, nylon fibers include Nylon 6 fibers and Nylon 66 fibers.

As a polyester that forms a polyester fiber, polyesters in which the main acid component is terephthalic acid, and the main glycol component is at least one member selected from the group consisting of $C_{2-6}$ alkylene glycols, that is, ethylene glycol, trimethylene glycol, tetramethylene glycol, pentamethylene glycol, and hexamethylene glycol, are preferable. Among them, a polyester whose main glycol component is ethylene glycol (polyethylene terephthalate) and a polyester whose main glycol component is trimethylene glycol (polytrimethylene terephthalate) are particularly preferable.

Such a polyester may have a copolymer component in a small amount (usually 30 mol % or less) as necessary. As bifunctional carboxylic acids other than terephthalic acid used in this case, for example, aromatic, aliphatic, and alicyclic bifunctional carboxylic acids such as isophthalic acid, naphthalenedicarboxylic acid, diphenyldicarboxylic acid, diphenoxyethanedicarboxylic acid, β-hydroxyethoxybenzoic acid, p-oxybenzoic acid, 5-sodium sulfoisophthalic acid, adipic acid, sebacic acid, and 1,4-cyclohexanedicarboxylic acid can be mentioned. In addition, as diol compounds other than the above glycols, for example, aliphatic, alicyclic, and aromatic diol compounds such as cyclohexane-1,4-dimethanol, neopentyl glycol, bisphenol A, and bisphenol S, polyoxyalkylene glycols, and the like can be mentioned.

The polyester may be synthesized by any method. For example, in the case of polyethylene terephthalate, its production is possible through a first-stage reaction in which terephthalic acid and ethylene glycol are directly subjected to an esterification reaction, a lower alkyl ester of terephthalic acid, such as dimethyl terephthalate, and ethylene glycol are subjected to a transesterification reaction, or terephthalic acid and ethylene oxide are allowed to react, thereby producing a glycol ester of terephthalic acid and/or an oligomer thereof, and a second-stage reaction in which the product of the first-stage reaction is heated under reduced pressure to cause a polycondensation reaction until the desired degree of polymerization is reached. In addition, the polyester may also be a material-recycled or chemically recycled polyester, or alternatively a polyester obtained using a catalyst containing a specific phosphorus compound and a titanium compound as described in JP-A-2004-270097 or JP-A-2004-211268. Further, the polyester may also be a biodegradable polyester, such as polylactic acid or stereocomplex polylactic acid.

When the polyester contains a UV absorber in an amount of 0.1 wt % or more (preferably 0.1 to 5.0 wt %) based on the polyester weight, this imparts UV-shielding properties to the cloth and thus is preferable. Examples of such UV absorbers include benzoxazine-based organic UV absorbers, benzophenone-based organic UV absorbers, benzotriazole-based organic UV absorbers, and salicylic acid-based organic UV absorbers. Among them, benzoxazine-based organic UV absorbers are particularly preferable in that they do not decompose during spinning.

Preferred examples of such benzoxazine-based organic UV absorbers are those disclosed in JP-A-62-11744. That is, 2-methyl-3,1-benzoxazin-4-one, 2-butyl-3,1-benzoxazin-4-one, 2-phenyl-3,1-benzoxazin-4-one, 2,2'-ethylenebis(3,1-benzoxazin-4-one), 2,2'-tetramethylenebis(3,1-benzoxazin-4-one), 2,2'-p-phenylenebis(3,1-benzoxazin-4-one), 1,3,5-tri(3,1-benzoxazin-4-on-2-yl)benzene, 1,3,5-tri(3,1-benzoxazin-4-on-2-yl)naphthalene, and the like can be mentioned.

In addition, when the polyester contains a delusterant (titanium dioxide) in an amount of 0.1 wt % or more (preferably 0.2 to 4.0 wt %) based on the polyester weight, this improves the anti-see-through properties of the cloth and thus is preferable.

Further, as necessary, the polyester may also contain one or more kinds of micropore-forming agents (metal organosulfonates), coloring inhibitors, heat stabilizers, flame retardants (diantimony trioxide), fluorescent brighteners, coloring pigments, antistatic agents (metal sulfonates), moisture absorbers (polyoxyalkylene glycols), antibacterial agents, and other inorganic particles.

In addition, when the false-twist crimped yarn A having torque in the S-direction and the false-twist crimped yarn B having torque in the Z-direction are different from each other in the fiber-forming components, the single-fiber transverse cross-sectional shape, or the single fiber fineness, this provides a cloth with a novel appearance and thus is preferable.

Here, "different in the components" includes not only a combination of different kinds of polymers, but also a combination of the same kind of polymers having different third components or additives. For example, examples thereof include a combination of nylon and polyester, a cationic dyeable polyester and a non-cationic dyeable polyester, polytrimethylene terephthalate and polyethylene terephthalate, or polyesters having different titanium oxide contents (e.g., bright polyester and semi-dull polyester, bright polyester and full-dull polyester, semi-dull polyester and full-dull polyester, etc.).

In addition, as the stretch fiber, a fiber made of one component composed of polytrimethylene terephthalate, a conjugate fiber made of two components joined in a side-by-side manner or an eccentric sheath-core manner, an elastic fiber (polyurethane-based fiber, polyether ester-based fiber, moisture-absorbing elastomer fiber, etc.), an undrawn polyester fiber, or the like is preferable. In particular, a conjugate fiber made of two components joined in a side-by-side manner or an eccentric sheath-core manner develops coil-like crimp upon heating and is preferable. Incidentally, the stretch fiber is preferably different from the crimped yarn.

Here, the conjugate fiber is preferably a conjugate fiber in which at least one component is composed of polytrimethylene terephthalate, polybutylene terephthalate, or polyethylene terephthalate. Specifically, examples of such two components include polytrimethylene terephthalate and polytrimethylene terephthalate, polytrimethylene terephthalate and polyethylene terephthalate, polyethylene terephthalate and polyethylene terephthalate, and polyethylene terephthalate and polybutylene terephthalate.

Here, polytrimethylene terephthalate refers to a fiber made of a polyester whose main repeating unit is a trimethylene terephthalate unit, in which the trimethylene terephthalate unit is 50 mol % or more, preferably 70 mol % or more, still more preferably 80 mol % or more, and particularly preferably 90 mol % or more. Therefore, polytrimethylene terephthalate containing, as third components, other acid components and/or glycol components in a total amount within a range of 50 mol % or less, preferably 30 mol % or less, still more preferably 20 mol % or less, and particularly preferably 10 mol % or less, is contained.

Polytrimethylene terephthalate is produced by condensing terephthalic acid or a functional derivative thereof and trimethylene glycol or a functional derivative thereof in the presence of a catalyst under appropriate reaction conditions.

As third components to be added, aliphatic dicarboxylic acids (oxalic acid, adipic acid, etc.), alicyclic dicarboxylic acids (cyclohexanedicarboxylic acid, etc.), aromatic dicarboxylic acids (isophthalic acid, sodium sulfoisophthalate, etc.), aliphatic glycols (ethylene glycol, 1,2-trimethylene glycol, tetramethylene glycol, etc.), alicyclic glycols (cyclohexane glycol, etc.), aromatic dioxy compounds (hydroquinone bisphenol A, etc.), aromatic group-containing aliphatic glycols (1,4-bis(β-hydroxyethoxy)benzene, etc.), aliphatic oxycarboxylic acids (p-oxybenzoic acid, etc.), and the like can be mentioned.

The polyethylene terephthalate may be obtained by the copolymerization of three components or may also be obtained by material recycling or chemical recycling. Further, it may also be obtained using a catalyst containing a specific phosphorus compound or titanium compound as described in JP-A-2004-270097 or JP-A-2004-211268.

The polytrimethylene terephthalate, polyethylene terephthalate, polybutylene terephthalate, and the like described above may contain one or more kinds of micropore-forming agents, cationic dye dyeable agents, coloring inhibitors, heat stabilizers, fluorescent brighteners, delusterants, colorants, moisture absorbents, and inorganic fine particles.

The conjugate fiber can be produced by the method described in JP-A-2009-46800, for example.

In the invention, the composite yarn contains a crimped yarn (preferably containing the false-twist crimped yarn A having torque in the S-direction and the false-twist crimped yarn B having torque in the Z-direction) and a stretch fiber.

In this case, in the crimped yarn or the stretch fiber, the single fiber fineness is preferably within a range of 0.00002 to 2.0 dtex (more preferably 0.1 to 1.0 dtex, particularly preferably 0.3 to 0.95 tex).

In addition, in the crimped yarn or the stretch fiber, as the single-fiber cross-sectional shape, in addition to a round cross-section, the cross-section may also be elliptical, triangular, quadrangular, cross-shaped, flat, flat with constrictions, H-shaped, W-shaped, or the like, for example. In this case, in terms of the softness of the cloth, it is preferable that the cross-sectional flatness of a flat cross-sectional shape, which is represented by the ratio b/c1 of the length b in the longitudinal centerline direction relative to the maximum width c1 in the direction orthogonal to the longitudinal centerline direction, is within a range of 2 to 6 (more preferably 3.1 to 5.0). In addition, in terms of the water absorbency of the cloth, it is preferable that the ratio c1/c2 of the maximum width c1 relative to the minimum width c2 is within a range of 1.05 to 4.00 (more preferably 1.1 to 1.5).

Methods for producing the composite yarn are not particularly limited. For example, it is possible that the false-twist crimped yarn A having torque in the S-direction, the false-twist crimped yarn B having torque in the Z-direction, and a stretch fiber are aligned, and then air-mingled by air texturing (interlacing processing or Taslan® processing), composite false-twisted, or plied. The air mingling method is particularly preferable.

In this case, the composite yarn is preferably an entangled yarn that has been subjected to interlacing processing to have 1 to 150 entanglements/m.

In addition, when the three kinds of yarns are combined, the overfeed rate may be suitably changed. Further, it is also possible that two kinds of yarns are first combined, and then the other yarn is combined in the subsequent step.

In the composite yarn, the total fineness is preferably within a range of 40 to 180 dtex. In addition, the crimp degree is preferably 2% or more (more preferably 10 to 60%). When the crimp degree is less than 2%, the stretchability may decrease.

The cloth of the invention includes the composite yarn. In this case, the composite yarn is preferably present in an amount of 50 wt % or more based on the cloth weight.

The structure of the cloth is not particularly limited, and may be a knitted fabric or a woven fabric. For example, preferred examples thereof include, but are not limited to, a woven fabric having a woven structure such as plain weave, twill weave, or satin, a knitted fabric having a knitted structure such as jersey, knit-miss, interlock, rib, moss, plated stitch, denbigh, or half, and a nonwoven fabric. Also with respect to the number of layers, the structure may be monolayered or may also be multilayered having two or more layers. Among them, in terms of obtaining excellent stretchability, a knitted fabric is preferable. In particular, a knitted fabric having a warp-knitted or weft-knitted (circular-knitted) structure is preferable.

In this case, in the knitted fabric, the knitted fabric density is preferably such that the number of courses is 40 to 100/2.54 cm, and the number of wales is 30 to 60/2.54 cm.

In the cloth of the invention, the weight per unit of the cloth is preferably within a range of 50 to 200 g/m$^2$.

The cloth of the invention is obtained by knitting or weaving in the usual manner using the composite yarn described above (optionally together with other fibers).

The cloth is then preferably subjected to dyeing processing. In this case, it is preferable that the dyeing processing temperature is 100 to 140° C. (more preferably 110 to 135° C.), and the time is such that the top temperature is kept for a period of time within a range of 5 to 40 minutes. The dyeing-processed knitted fabric is preferably subjected to dry-heat final setting. In this case, it is preferable that the dry-heat final setting temperature is 120 to 200° C. (more preferably 140 to 180° C.), and the time is within a range of 1 to 3 minutes.

As a result of such heat treatments during dyeing processing, in the case where a conjugate fiber made of two components joined in a side-by-side manner or an eccentric sheath-core manner is present in the cloth, the conjugate fiber develops latent crimp and is coiled. As a result, excellent stretchability is imparted to the cloth.

In addition, it is preferable that the cloth of the invention has been subjected to water-absorbing processing (a hydrophilizing agent is imparted). The cloth that has been subjected to water-absorbing processing has improved water absorbency. As such water-absorbing processing, for example, it is preferable that a hydrophilizing agent (water-absorbing processing agent), such as polyethylene glycol diacrylate, a derivative thereof, or a polyethylene terephthalate-polyethylene glycol copolymer, is attached to the cloth in an amount of 0.25 to 0.50 wt % based on the cloth weight. Examples of water-absorbing processing methods include an in-bath processing method in which a water-absorbing processing agent is mixed with a dyeing liquid at the time of dyeing processing, a method in which before dry-heat final setting, the cloth is dipped in a water-absorbing processing liquid and squeezed with a mangle, and coating processing methods such as gravure coating and screen printing.

Further, it is also possible to additionally apply napping or UV shielding in the usual manner, or various kinds of function-imparting processing with an antibacterial agent, a deodorant, an insect repellent, a phosphorescent agent, a retroreflective agent, a minus ion generator, a water repellent, and the like.

The cloth thus obtained has unique stretchability resulting from the combination of the soft elongation of the crimped yarn (preferably containing the false-twist crimped yarn A having torque in the S-direction and the false-twist crimped yarn B having torque in the Z-direction) and the excellent kickback of the stretch fiber (preferably a conjugate fiber made of two components joined in a side-by-side manner or an eccentric sheath-core manner), and offers a sense of ideal compression. In addition, because of the random yarn structure, the cloth has a natural fiber-like, high-quality texture and a compact nature with softness and a sense of denseness, offering a texture with a sense of luxury. In addition, the layered yarns obtained by combining two different kinds of crimp (micro-crimp of the crimped yarn and coil-like crimp of the stretch fiber) cause a capillary action, resulting in excellent sweat-absorbing and quick-drying properties. Further, in the case where water-repelling processing is applied, when the crimped yarn contains the false-twist crimped yarn A having torque in the S-direction and the false-twist crimped yarn B having torque in the Z-direction, the resulting cloth has minute irregularities and thus has excellent water repellency.

Here, it is preferable that on at least one of the front and back surfaces of the cloth, the water absorbency measured in accordance with JIS L1907-19985.1.2, Byreck Method, is 7 cm or more (more preferably 7 to 15 cm).

In addition, it is preferable that on at least one of the front and back surfaces of the cloth after three washes in accordance with JIS L0217-1998, 103 Method, the water absorbency measured in accordance with JIS L1907-19985.1.2, Byreck Method, is 8 cm or more (more preferably 8 to 16 cm).

In addition, as snagging resistance, it is preferable that the snagging resistance tested in accordance with JIS L 1058-1995, D3 Method, Hacksaw, for 15 hours is Class 3 or higher.

In addition, at the same time, the cloth of the invention offers stretchability caused by the crimped fiber. As such stretchability, it is preferable that the lateral stretchability measured in accordance with JIS L 1018-1990 is 10% or more, preferably 15 to 150%, and still more preferably 50 to 130%. In addition, it is preferable that the rate of recovery of the lateral stretchability measured in accordance with JIS L 1018-1990 is 85% or more, preferably 90% or more.

In addition, the invention provides a textile product using the above cloth and selected from the group consisting of garments, lining fabrics, interlining fabrics, socks, belly bands, hats, gloves, pajamas, futon's outer fabrics, futon covers, and car seat upholstery materials. The garments include fashion garments, school uniforms, uniforms, and the like. The textile product uses the cloth described above, and thus is extremely excellent in stretchability and sweat-absorbing and quick-drying properties and further has a natural material-like texture and appearance.

EXAMPLES

Hereinafter, the invention will be described in detail with reference to examples, but the invention is not limited thereto. Incidentally, the properties in the Examples were measured by the following methods.

(1) Degree of Interlacing

An entangled yarn 1 m long is taken under a load of 8.82 mN×indicated tex (0.1 g/de). The load is removed, then the yarn is allowed to crimp at room temperature for 24 hours, and the number of nodes is read and indicated as the number/m.

(2) Crimp Degree

A test yarn is wound around a sizing reel having a perimeter of 1.125 m to prepare a skein having a dry fineness of 3,333 dtex. The skein is hung on a hanger nail on a scale plate, then an initial load of 6 g is applied to its lower part, and further a load of 600 g is applied. The skein length L0 at this time is measured. The load is then immediately removed from the skein, and the skein is removed from the hanger nail on the scale plate and immersed in boiling water for 30 minutes, allowing the crimp to be developed. The boiling-water-treated skein is taken out from boiling water, and moisture contained in the skein is removed by absorption on filter paper, followed by air-drying at room temperature for 24 hours. The air-dried skein is hung on a hanger nail on a scale plate, then a load of 600 g is applied to its lower part, and, after 1 minute, the skein length L1*a* is measured. The load is then removed from the skein, and, after 1 minute, the skein length L2*a* is measured. The crimp degree (CP) of the test filament yarn is calculated by the following equation.

$$CP\ (\%)=((L1a-L2a)/L0)\times 100$$

(3) Lateral Stretchability, Rate of Recovery of Lateral Stretchability

Measurement is performed in accordance with JIS L 1018-1990.

(4) Snagging Resistance

Testing is performed in accordance with JIS L 1058-1995, D3 Method, Hacksaw, for 15 hours.

(5) Weight Per Unit

Measurement is performed in accordance with JIS L1018-19986.4.

(6) Sweat-Absorbing and Quick-Drying Properties (Residual Water Content)

0.6 ml of purified water is dropped onto a 20×20 cm specimen. When the specimen has absorbed water drops, the sample is attached to an automatic drying rate measuring apparatus, and the changes in mass every 5 minutes are measured for 90 minutes. The residual water content in 55 minutes, which is considered as the standard for sweat-absorbing and quick-drying properties, was comparatively evaluated.

Residual water content (%)=(the amount of remaining dropped water at an arbitrary period of time/the amount of dropped water at the start of measurement)×100

Example 1

Non-cationic dyeable polyethylene terephthalate (delusterant content: 0.3 wt %, semi-dull (SD)) was melt-spun at 280° C. from an ordinary spinning apparatus, then taken up at a rate of 2,800 m/min, and wound up without drawing to give a semi-drawn polyester yarn (total fineness: 35 dtex/24 fil, single-fiber cross-sectional shape: round cross-section, POY).

Next, the polyester yarn was subjected to simultaneous drawing and false-twist crimping under the following conditions: draw ratio: 1.6, the number of false twists: 2,500 T/m (S-direction), heater temperature: 180° C., yarn speed: 350 m/min, thereby giving a false-twist crimped yarn A having a total fineness of 22 dtex/24 fil.

Meanwhile, the polyester yarn was subjected to simultaneous drawing and false-twist crimping under the following conditions: draw ratio: 1.6, the number of false twists: 2,500 T/m (Z-direction), heater temperature: 180° C., yarn speed: 350 m/min, thereby giving a false-twist crimped yarn B having a total fineness of 22 dtex/24 fil.

In addition, in the method described in JP-A-2009-46800, Example 24, only the total fineness and the number of filaments were changed, and a conjugate fiber having a total fineness of 33 dtex/24 fil (stretch fiber) made of a polytrimethylene terephthalate (PTT) component and a polyethylene terephthalate (PET) component joined in a side-by-side manner was obtained.

Next, the false-twist crimped yarn A having torque in the S-direction, the false-twist crimped yarn B having torque in the Z-direction, and the conjugate fiber (stretch fiber) were combined together and subjected to an air-entangling treatment, thereby giving a composite yarn (total fineness: 77 dtex/72 fil, crimp degree: 16%, torque: 0 T/m). The air-entangling treatment in this case was interlacing processing using an interlace nozzle, and 103 entanglements/m were imparted.

Next, using a 46-gauge circular knitting machine, a circular-knitted fabric having a jersey structure was knitted using the above composite yarn.

Then, the knitted fabric was subjected to dyeing processing using a disperse dye at a temperature of 130° C. with a keep time of 15 minutes. At the time of this dyeing processing, the fabric was treated in the same bath with a hydrophilizing agent (polyethylene terephthalate-polyethylene glycol copolymer) at a proportion of 2 ml/l relative to the dyeing liquid, whereby the hydrophilizing agent was imparted to the knitted fabric. Next, the circular-knitted fabric was subjected to dry-heat final setting at a temperature of 160° C. for 1 minute.

The obtained knitted fabric (cloth) was excellent in water-absorbing and quick-drying properties and stretchability, and also had a natural material-like texture and appearance resulting from the sense of unevenness in appearance and texture. The evaluation results are shown in Table 1.

Example 2

Non-cationic dyeable polyethylene terephthalate (delusterant content: 0.3 wt %, semi-dull) was melt-spun at 280° C. from an ordinary spinning apparatus, then taken up at a rate of 2,800 m/min, and wound up without drawing to give a semi-drawn polyester yarn (total fineness: 35 dtex/72 fil, single-fiber cross-sectional shape: round cross-section, POY).

Next, the polyester yarn was subjected to simultaneous drawing and false-twist crimping under the following conditions: draw ratio: 1.6, the number of false twists: 2,500 T/m (S-direction), heater temperature: 180° C., yarn speed: 350 m/min, thereby giving a false-twist crimped yarn A having a total fineness of 22 dtex/72 fil.

Meanwhile, the polyester yarn was subjected to simultaneous drawing and false-twist crimping under the following conditions: draw ratio: 1.6, the number of false twists: 2,500 T/m (Z-direction), heater temperature: 180° C., yarn speed: 350 m/min, thereby giving a false-twist crimped yarn B having a total fineness of 22 dtex/72 fil.

In addition, in the method described in JP-A-2009-46800, Example 24, only the total fineness and the number of filaments were changed, and a conjugate fiber having a total fineness of 33 dtex/24 fil (stretch fiber) made of a polytrimethylene terephthalate component and a polyethylene terephthalate component joined in a side-by-side manner was obtained.

Next, the false-twist crimped yarn A having torque in the S-direction, the false-twist crimped yarn B having torque in the Z-direction, and the conjugate fiber (stretch fiber) were combined together and subjected to an air-entangling treatment, thereby giving a composite yarn (total fineness: 77 dtex/168 fil, crimp degree: 13%, torque: 0 T/m). The air-entangling treatment in this case was interlacing processing using an interlace nozzle, and 98 entanglements/m were imparted.

Next, using a 46-gauge circular knitting machine, a circular-knitted fabric having a jersey structure was knitted using the above fiber.

Then, the knitted fabric was subjected to dyeing processing using a disperse dye at a temperature of 130° C. with a keep time of 15 minutes. At the time of this dyeing processing, the fabric was treated in the same bath with a hydrophilizing agent (polyethylene terephthalate-polyethylene glycol copolymer) at a proportion of 2 ml/l relative to the dyeing liquid, whereby the hydrophilizing agent was imparted to the knitted fabric. Next, the circular-knitted fabric was subjected to dry-heat final setting at a temperature of 160° C. for 1 minute.

The obtained knitted fabric (cloth) was excellent in water-absorbing and quick-drying properties and stretchability, and also had a natural material-like texture and appearance resulting from the sense of unevenness in appearance and texture. The evaluation results are shown in Table 1.

Example 3

Non-cationic dyeable polyethylene terephthalate (delusterant content: 2.5 wt %, full-dull (FD)) was melt-spun at 280° C. from an ordinary spinning apparatus, then taken up at a rate of 2,800 m/min, and wound up without drawing to give a semi-drawn polyester yarn (total fineness: 56 dtex/36 fil, single-fiber cross-sectional shape: round cross-section, POY).

Next, the polyester yarn was subjected to simultaneous drawing and false-twist crimping under the following conditions: draw ratio: 1.6, the number of false twists: 2,500 T/m (S-direction), heater temperature: 180° C., yarn speed: 350 m/min, thereby giving a false-twist crimped yarn A having a total fineness of 33 dtex/36 fil.

Meanwhile, cationic dyeable copolymerized polyethylene terephthalate (copolymerized with 5-sodium sulfoisophthalic acid, delusterant content: 0.3 wt %, CD) was melt-spun at 280° C. from an ordinary spinning apparatus, then taken up at a rate of 2,800 m/min, and wound up without drawing to give a semi-drawn polyester yarn (total fineness: 56 dtex/36 fil, single-fiber cross-sectional shape: round cross-section, POY).

Next, the polyester yarn was subjected to simultaneous drawing and false-twist crimping under the following conditions: draw ratio: 1.6, the number of false twists: 2,500 T/m (Z-direction), heater temperature: 180° C., yarn speed: 350 m/min, thereby giving a false-twist crimped yarn B having a total fineness of 33 dtex/36 fil.

In addition, a fiber having a total fineness of 56 dtex/36 fil (stretch fiber) composed of polytrimethylene terephthalate alone was prepared.

Next, the false-twist crimped yarn A having torque in the S-direction, the false-twist crimped yarn B having torque in the Z-direction, and the fiber having a total fineness of 56 dtex/36 fil (stretch fiber) composed of polytrimethylene terephthalate alone were combined together and subjected to an air-entangling treatment, thereby giving a composite yarn (total fineness: 122 dtex/108 fil, crimp degree: 21%, torque: 0 T/m). The air-entangling treatment in this case was interlacing processing using an interlace nozzle, and 90 entanglements/m were imparted.

Next, using a 28-gauge circular knitting machine, a circular-knitted fabric having a jersey structure was knitted using the above composite yarn.

Then, the knitted fabric was subjected to dyeing processing using a disperse dye at a temperature of 130° C. with a keep time of 15 minutes. At the time of this dyeing processing, the fabric was treated in the same bath with a hydrophilizing agent (polyethylene terephthalate-polyethylene glycol copolymer) at a proportion of 2 ml/l relative to the dyeing liquid, whereby the hydrophilizing agent was imparted to the knitted fabric. Next, the circular-knitted fabric was subjected to dry-heat final setting at a temperature of 160° C. for 1 minute.

The obtained knitted fabric (cloth) was excellent in water-absorbing and quick-drying properties and stretchability, and also had a natural material-like texture and appearance resulting from the sense of unevenness in appearance and texture. The evaluation results are shown in Table 1.

Example 4

Non-cationic dyeable polyethylene terephthalate (delusterant content: 2.5 wt %, full-dull (FD)) was melt-spun at 280° C. from an ordinary spinning apparatus, then taken up at a rate of 2,800 m/min, and wound up without drawing to give a semi-drawn polyester yarn (total fineness: 56 dtex/36 fil, single-fiber cross-sectional shape: round cross-section, POY).

Next, the polyester yarn was subjected to simultaneous drawing and false-twist crimping under the following conditions: draw ratio: 1.6, the number of false twists: 2,500 T/m (S-direction), heater temperature: 180° C., yarn speed: 350 m/min, thereby giving a false-twist crimped yarn A having a total fineness of 33 dtex/36 fil.

Meanwhile, cationic dyeable copolymerized polyethylene terephthalate (copolymerized with 5-sodium sulfoisophthalic acid, delusterant content: 0.3 wt %, CD) was melt-spun at 280° C. from an ordinary spinning apparatus, then taken up at a rate of 2,800 m/min, and wound up without drawing to give a semi-drawn polyester yarn (total fineness: 56 dtex/36 fil, single-fiber cross-sectional shape: round cross-section, POY).

Next, the polyester yarn was subjected to simultaneous drawing and false-twist crimping under the following conditions: draw ratio: 1.6, the number of false twists: 2,500 T/m (Z-direction), heater temperature: 180° C., yarn speed: 350 m/min, thereby giving a false-twist crimped yarn B having a total fineness of 33 dtex/36 fil.

In addition, in the method described in JP-A-2009-46800, only the total fineness and the number of filaments were changed, and a conjugate fiber having a total fineness of 56 dtex/36 fil (stretch fiber) made of a polybutylene terephthalate component and a polyethylene terephthalate component joined in a side-by-side manner was obtained.

Next, the false-twist crimped yarn A having torque in the S-direction, the false-twist crimped yarn B having torque in the Z-direction, and the conjugate fiber (stretch fiber) were combined together and subjected to an air-entangling treatment, thereby giving a composite yarn (total fineness: 122 dtex/108 fil, crimp degree: 16%, torque: 0 T/m). The air-entangling treatment in this case was interlacing processing using an interlace nozzle, and 100 entanglements/m were imparted.

Next, using a 28-gauge circular knitting machine, a circular-knitted fabric having a jersey structure was knitted using the above composite yarn.

Then, the knitted fabric was subjected to dyeing processing using a disperse dye at a temperature of 130° C. with a keep time of 15 minutes. At the time of this dyeing processing, the fabric was treated in the same bath with a hydrophilizing agent (polyethylene terephthalate-polyethylene glycol copolymer) at a proportion of 2 ml/l relative to the dyeing liquid, whereby the hydrophilizing agent was imparted to the knitted fabric. Next, the circular-knitted fabric was subjected to dry-heat final setting at a temperature of 160° C. for 1 minute.

The obtained knitted fabric (cloth) was excellent in water-absorbing and quick-drying properties and stretchability, and also had a natural material-like texture and appearance resulting from the sense of unevenness in appearance and texture. The evaluation results are shown in Table 1.

Comparative Example 1

Non-cationic dyeable polyethylene terephthalate (delusterant content: 2.5 wt %, full-dull) was melt-spun at 280° C. from an ordinary spinning apparatus, then taken up at a rate of 2,800 m/min, and wound up without drawing to give a semi-drawn polyester yarn (total fineness: 56 dtex/36 fil, single-fiber cross-sectional shape: round cross-section, POY).

Next, the polyester yarn was subjected to simultaneous drawing and false-twist crimping under the following conditions: draw ratio: 1.6, the number of false twists: 2,500 T/m (S-direction), heater temperature: 180° C., yarn speed: 350 m/min, thereby giving a false-twist crimped yarn A having a total fineness of 33 dtex/36 fil.

Meanwhile, cationic dyeable copolymerized polyethylene terephthalate (copolymerized with 5-sodium sulfoisophthalic acid, delusterant content: 0.3 wt %) was melt-spun at 280° C. from an ordinary spinning apparatus, then taken up at a rate of 2,800 m/min, and wound up without drawing to give a semi-drawn polyester yarn (total fineness: 56 dtex/36 fil, single-fiber cross-sectional shape: round cross-section, POY).

Next, the polyester yarn was subjected to simultaneous drawing and false-twist crimping under the following conditions: draw ratio: 1.6, the number of false twists: 2,500 T/m (Z-direction), heater temperature: 180° C., yarn speed: 350 m/min, thereby giving a false-twist crimped yarn B having a total fineness of 33 dtex/36 fil.

Next, the false-twist crimped yarns A having torque in the S-direction and the false-twist crimped yarn B having torque in the Z-direction were combined together and subjected to an air-entangling treatment, thereby giving a composite yarn (total fineness: 66 dtex/72 fil, crimp degree: 18%, torque: 4 T/m) which is a crimpled fiber. The air-entangling treatment in this case was interlacing processing using an interlace nozzle, and 95 entanglements/m were imparted at an over-feed rate of 1.0%.

Next, using a 28-gauge circular knitting machine, a circular-knitted fabric having a honeycomb structure was knitted using the above composite yarn.

Then, the knitted fabric was subjected to dyeing processing using a cationic dye at a temperature of 130° C. with a keep time of 15 minutes. At the time of this dyeing processing, the fabric was treated in the same bath with a hydrophilizing agent (polyethylene terephthalate-polyethylene glycol copolymer) at a proportion of 2 ml/l relative to the dyeing liquid, whereby the hydrophilizing agent was imparted to the knitted fabric. Next, the circular-knitted fabric was subjected to dry-heat final setting at a temperature of 160° C. for 1 minute.

The obtained knitted fabric was excellent in stretchability, and also had a novel texture and a novel appearance resulting from the sense of unevenness in appearance and texture, but was poor in terms of quick-drying properties. The evaluation results are shown in Table 1.

TABLE 1

| | | Example 1 | Example 2 | Example 3 | Example 4 | Comparative Example 1 |
|---|---|---|---|---|---|---|
| Yarn Type | False-twist crimped yarn A (S-twist) | SD 22T24 | SD 22T72 | FD 33T36 | FD 33T36 | FD 33T36 |
| | False-twist crimped yarn B (Z-twist) | SD 22T24 | SD 22T72 | CD 33T36 | CD 33T36 | CD 33T36 |
| | Stretch fiber | PTT/PET SD 33T24 | PTT/PET SD 33T24 | PTT SD 56T36 | PBT/PET SD 56T36 | — |
| | Torque (T/m) | 0 | 0 | 0 | 0 | 4 |
| | Crimp degree (%) | 16 | 13 | 21 | 16 | 18 |
| | I.L. (entanglements/m) | 103 | 98 | 90 | 100 | 95 |
| Knitted Fabric | Type of knitting machine (gauge) | 46G Single | 46G Single | 28G Single | 28G Single | 28G Double |
| | Structure | Jersey | Jersey | Jersey | Jersey | Honeycomb |
| | Weight per unit | 129 | 130 | 111 | 115 | 120 |
| | Course (yarns/2.54 cm) | 92 | 84 | 53 | 54 | 56 |
| | Wale (yarns/2.54 cm) | 59 | 64 | 46 | 46 | 44 |
| | Snagging resistance (D3 Method, Class) | 4.5 | 4.5 | 4.5 | 4.5 | 4.5 |
| | Stretchability (lateral, %) | 101.8 | 120.6 | 120.3 | 115 | 101.3 |
| | Stretchability recovery rate (lateral, %) | 92.6 | 91.6 | 91.1 | 89.5 | 83.5 |
| | Residual water content in 55 min (%) | 0 | 2.3 | 0 | 0 | 39.6 |

INDUSTRIAL APPLICABILITY

According to the invention, a cloth and a textile product, which are extremely excellent in stretchability and sweat-absorbing and quick-drying properties, are provided, and the industrial value thereof is extremely high.

The invention claimed is:

1. A cloth comprising a composite yarn, the cloth being characterized in that the composite yarn contains a crimped yarn and a stretch fiber, wherein the crimped yarn contains a false-twist crimped yarn A having torque in the S-direction and a false-twist crimped yarn B having torque in the Z-direction, and the crimped yarn or the stretch fiber has a single fiber fineness within a range of 0.1 to 1.0 dtex, and the stretch fiber is a conjugate fiber made of two components joined in a side-by-side manner or an eccentric sheath-core manner, or is a polytrimethylene terephthalate fiber, and the two components include polytrimethylene terephthalate and polytrimethylene terephthalate, or polytrimethylene terephthalate and polyethylene terephthalate, and the composite yarn is an entangled yarn that has been subjected to interlacing processing to have 98 to 150 entanglements/m, and the composite yarn has a total fineness within a range of 40 to 180 dtex, and the cloth is a knitted fabric having a circular-knitted structure, and a hydrophilizing agent is imparted to the cloth, and in the knitted fabric, a number of courses is 40 to 100/2.54 cm, and a number of wales is 30 to 60/2.54 cm, and a weight per unit of the cloth is within a range of 50 to 200 g/m$^2$.

2. A textile product comprising the cloth according to claim 1 and selected from the group consisting of garments, lining fabrics, interlining fabrics, socks, belly bands, hats, gloves, pajamas, futon outer fabrics, futon covers, and car seat upholstery materials.

3. A cloth comprising a composite yarn, the cloth being characterized in that the composite yarn contains a crimped yarn and a stretch fiber, wherein the crimped yarn contains a false-twist crimped yarn A having torque in the S-direction and a false-twist crimped yarn B having torque in the Z-direction, and the crimped yarn or the stretch fiber has a single fiber fineness within a range of 0.1 to 1.0 dtex, and the stretch fiber is a conjugate fiber made of two components joined in a side-by-side manner or an eccentric sheath-core manner, or is a polytrimethylene terephthalate fiber, and the two components include polytrimethylene terephthalate and polytrimethylene terephthalate, or polytrimethylene terephthalate and polyethylene terephthalate, and the composite yarn is an entangled yarn that has been subjected to interlacing processing to have 98 to 150 entanglements/m, and the composite yarn has a total fineness within a range of 40 to 180 dtex, and the cloth is a knitted fabric, and a hydrophilizing agent is imparted to the cloth.

4. The cloth according to claim 3, wherein the entangled yarn has 100 to 150 entanglements/m.

5. The cloth according to claim 3, wherein the entangled yarn has 103 to 150 entanglements/m.

* * * * *